US010336661B2

(12) United States Patent
Gangopadhyay et al.

(10) Patent No.: US 10,336,661 B2
(45) Date of Patent: Jul. 2, 2019

(54) HIERARCHICAL SELF-ASSEMBLED ENERGETIC MATERIALS AND FORMATION METHODS

(71) Applicant: The Curators of the University of Missouri, Columbia, MO (US)

(72) Inventors: Shubhra Gangopadhyay, Columbia, MO (US); Stephen W. Chung, Florissant, MO (US); Rajagopalan Thiruvengadathan, Columbia, MO (US); Clay Stephen Staley, Columbia, MO (US); Keshab Gangopadhyay, Columbia, MO (US); Kristofer Emile Raymond, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 274 days.

(21) Appl. No.: 14/451,001

(22) Filed: Aug. 4, 2014

(65) Prior Publication Data

US 2015/0034220 A1 Feb. 5, 2015

Related U.S. Application Data

(60) Provisional application No. 61/958,749, filed on Aug. 5, 2013.

(51) Int. Cl.
*C06B 45/00* (2006.01)
*C06B 45/18* (2006.01)
(Continued)

(52) U.S. Cl.
CPC ..... *C06B 45/18* (2013.01); *C06B 21/0008* (2013.01); *C06B 33/00* (2013.01)

(58) Field of Classification Search
CPC ..... C06B 45/00; C06B 45/18; C06B 33/00
See application file for complete search history.

(56) References Cited

U.S. PATENT DOCUMENTS 7,025,840 B1 * 4/2006 Adams ..... B82Y 30/00 149/108.2
7,833,366 B1 * 11/2010 Forohar ..... B82Y 30/00 149/109.4

(Continued)

OTHER PUBLICATIONS

Bezmelnitsyn et al., "Modified Nanoenergetic Composites with Tunable Combustion Characteristics for Propellant Applications", Propellants, Explosives, Pyrotechnics, vol. 35, pp. 384-394, 2010.

(Continued)

*Primary Examiner* — Aileen B Felton
(74) *Attorney, Agent, or Firm* — Greer, Burns & Crain, Ltd.; Steven P. Fallon

(57) ABSTRACT

An energetic nanocomposite includes fuel nanoparticles and oxidizer nanoparticles covalently bonded to negatively charged functionalized graphene sheets. A preferred example includes Al fuel nanoparticles and $Bi_2O_3$ nanoparticles. A preferred method of formation mixes a solution of positively charged fuel nanoparticles, positively charged oxidizer nanoparticles, and negatively charged functionalized graphene sheets having functional groups to bond with the positively charged fuel nanoparticles and positively charged oxidizer nanoparticles. Self-assembly of the energetic nanocomposite is permitted over a predetermined time via the attraction and aggregation of the positively charged fuel nanoparticles positively charged oxidizer nanoparticles and negatively charged functionalized graphene sheets. Additional methods and nanocomposites include unfunctionalized graphene sheets, which can be commercial grade sheets.

11 Claims, 10 Drawing Sheets

(51) Int. Cl.
*C06B 33/00* (2006.01)
*C06B 21/00* (2006.01)

(56) References Cited

U.S. PATENT DOCUMENTS 8,277,585 B1 * 10/2012 Yalamanchili ..... C06B 23/001
149/108.2
2011/0167795 A1 7/2011 Gangopadhyay et al.
2014/0227548 A1 * 8/2014 Myrick ..... C06B 45/30
428/570

OTHER PUBLICATIONS

Fischer et al., "Theoretical Energy Release of Thermites, Intermetallics, and Combustible Metals", Presented at the 24th International Pyrotechnics Seminar, Monterey, California, Jul. 1998.
Patil et al., "Aqueous Stabilization and Self-Assembly of Graphene Sheets into Layered Bio-Nanocomposites using DNA", Advanced Materials, vol. 21, pp. 3159-3164, 2009.
Shen et al., "Layer-by-Layer Self-Assembly of Graphene Nanoplatelets", Langmuir, vol. 25, No. 11, pp. 6122-6128, Mar. 10, 2009.
Shende et al., "Nanoenergetic Composites of CuO Nanorods, Nanowires, and Al-Nanoparticles", Propellants, Explosives, Pyrotechnics, vol. 33, No. 2, pp. 122-130, 2008.
Wang et al., "Ternary Self-Assembly of Ordered Metal Oxide-Graphene Nanocomposites for Electrochemical Energy Storage", American Chemical Society Nano, vol. 4, No. 3, pp. 1587-1595, Feb. 25, 2010.

* cited by examiner

HIERARCHICAL SELF-ASSEMBLED ENERGETIC MATERIALS AND FORMATION METHODS

PRIORITY CLAIM AND REFERENCE TO RELATED APPLICATION

This application claims priority under 35 U.S.C. § 119 from prior provisional application No. 61/958,749, which was filed on Aug. 5, 2013.

GRANT STATEMENT

None.

FIELD OF THE INVENTION

A field of the invention is energetic materials. Example applications of energetic materials of the invention include reactive materials, solid propellant formulations and light armor systems.

BACKGROUND

Functionalized graphene sheets possess high surface area and a two-dimensional carbon, where the carbon to oxygen (C/O) ratio and surface functionalities are molecularly engineered based on synthesis parameters. Functionalized graphene sheets have been used to form nanocomposite materials for a variety of applications. The functionalized graphene sheets are most often utilized to increase mechanical strength and to increase electrical conductivity.

Wang et. al., Ternary self-assembly of ordered metal oxide-graphene nanocomposites for electrochemical energy storage," ACS Nano 4, 1587-95 (2010), describe surfactant chemistry as providing self-assembly of metal oxide and functionalized graphene sheet nanostructures. The nanostructures are described as having energy storage applications. Shen et. al., "Layer-by-Layer Self-Assembly of Graphene Nanoplatelets. Langmuir 25, 6122-28 (2009), describe complementary charged functionalized graphene sheets being chemically modified with polyelectrolytes that electrostatically assemble into layer-by-layer structures. Patil et. al., "Aqueous Stabilization and Self-Assembly of Graphene Sheets into Layered Bio-Nanocomposites using DNA. Adv. Mater. 21, 3159-64 (2009), report synthesis of lamellar bio nanocomposites prepared using functionalized graphene sheets with DNA functionalization.

Nanocomposite energetic materials are heterogeneous mixtures of metallic fuels (aluminum (Al), boron, magnesium, etc.) and inorganic oxidizers (cupric oxide, bismuth trioxide ($Bi_2O_3$), ferric oxide, etc.) with nanoscale dimensions. The organization, intimacy, and dimensions of the discrete fuels and oxidizers in the nanocomposites largely influence their combustion kinetics. Increasing the fuel and oxidizer interfacial contact area enhances the reaction rate of a nanocomposite. Nanocomposite energetic materials have been self-assembled using complementary DNA strands, electrostatically charged aerosols, and molecular polymer linkers.

SUMMARY OF THE INVENTION

An embodiment of the present invention is an energetic nanocomposite that includes fuel nanoparticles and oxidizer nanoparticles covalently bonded to negatively charged functionalized graphene sheets. A preferred example includes Al fuel nanoparticles and Bi2O3 nanoparticles. A method of formation mixes a solution of positively charged fuel nanoparticles, positively charged oxidizer nanoparticles, and negatively charged functionalized graphene sheets having functional groups to bond with the positively charged fuel nanoparticles and positively charged oxidizer nanoparticles. Self-assembly of the energetic nanocomposite is permitted over a predetermined time via the attraction and aggregation of the positively charged fuel nanoparticles positively charged oxidizer nanoparticles and negatively charged functionalized graphene sheets.

Additional embodiments utilize commercial grade (unfunctionalized) graphene (CG) for assembly with fuel/oxidizer to provide a self-assembly process and a nanoenergetic composite. With the CG, the self-assembly is primarily via electrostatic interaction

BRIEF DESCRIPTION OF THE DRAWINGS

FIG. 2A shows FGS in a few layers; FIG. 2B shows 80 nm average diameter Al nanoparticles; FIG. 2C shows $Bi_2O_3$ nanoparticles of average diameters in the range of 90-210 nm; and FIGS. 2D-2F show nanocomposites of the invention as dense structures.

DETAILED DESCRIPTION OF THE PREFERRED EMBODIMENTS

Figure 1A:
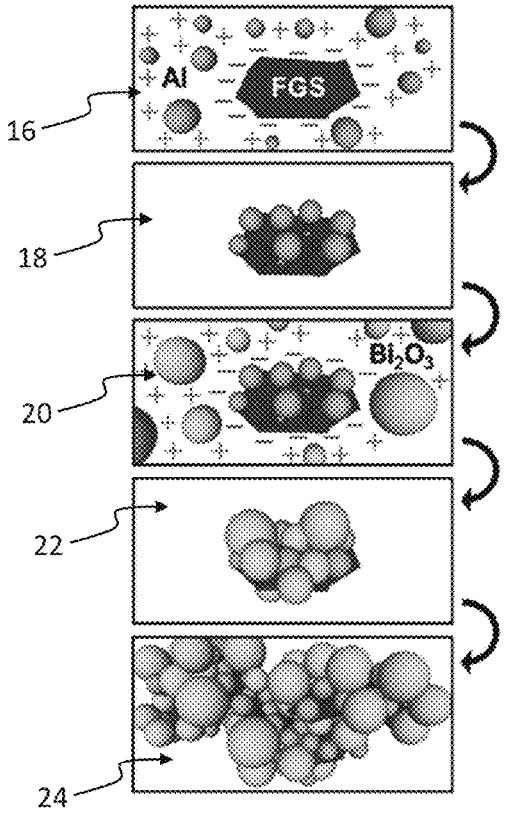
FIGS. 1A and 1B illustrate a preferred method for self-assembly of a $Bi_2O_3$, Al, and FGS (functionalized graphene sheets) nanocomposite.

Preferred embodiments of the invention provide nanoenegertic materials including fuel, oxidizer and functionalized graphene sheets. Preferred example functionalized graphene sheets (FGS) include graphene oxide (GO) aminated graphene (AG). Other embodiments include reduced graphene oxide (RGO). Additional embodiments include chemically engineered dense nanocomposite assemblies with highly reactive combustion characteristics. A preferred embodiment is a binary fuel and oxidizer fuel nanocomposite assembly. A preferred nanoparticle fuel and oxidizer $Al/Bi_2O_3$. Preferred FGS assembled nanoenergetics of the invention exhibit enhanced combustion performance by increasing nanoparticle packing density while contributing to the energetic yield. Bonding is via Van der Wall forces between molecules and chemical bonding of FGS with other nanoparticles.

Additional embodiments utilize commercial grade (unfunctionalized) graphene (CG) for assembly with fuel/oxidizer to provide a self-assembly process and a nanoenergetic composite. With the CG, the self-assembly is primarily via electrostatic interaction. The electrostatic attraction, although not as strong as chemical bonding, still has been demonstrated to provide a stable nanoenergetic composite. This method using CG is advantageous, as it can use non-treated commercially available graphene, while maintaining required stability for the nanoenergetic composite.

The graphene used in the invention, whether FGS or CG, is 2D graphene. Commercial grade CG that is 2D has few layers (~10 or less, and most typically 5 or less) and is about 2 nm thick on average. When thicker than ~10 layers, it is not considered graphene and is not 2D. CG can be defined as a combination of Graphene (~10 layers or, less) and graphite nano-platlelets.

Others have reported improvements in combustion characteristics for various energetic material formulations by the incorporation of FGS additives. Preferred methods of fabrication of the invention utilize FGS in a dual role of directing the self-assembly of a nanocomposite energetic material and as a performance enhancing additive. The self-assembly provided by method of the invention from nano- to macro length scales is facile and spontaneous, enabling self-organization of fuel nanoparticles such as Al and oxidizer nanoparticles such as bismuth oxide ($Bi_2O_3$) in intimate contact with each other on FGS. Self-assembled energetic materials of the invention provide combustion performance improvements compared to energetic materials formed by randomly mixing the fuel and oxidizer.

Preferred embodiment methods of the invention provide a self-assembly to form binary fuel and oxidizer nanocomposites. In a preferred methods, individual constituents into intimate contact with each other reaction kinetics are optimized. The invention further provides methods to synthesize FGS with tailored functionalities to produce hierarchical self-assembled nanoenergetics.

Preferred methods provide facile, spontaneous, and surfactant free controlled self-assembly of bismuth trioxide and aluminum nanopowders through the introduction of functionalized graphene sheets as a self-assembly directing agent. Layered, self-assembled nanostructures are spontaneously formed in accordance with a method of the invention. The nanostructures coalesce after initial formation into ultra-dense macrostructures including the nanostructured building blocks. Preferred example self-assembled nanocomposites demonstrate significant combustion performance improvements in comparison to randomly mixed nanopowders with enhancements in pressure generation from 60 to 200 MPa, reactivity from 3 to 16 MPa/μs, and burn rate from 1.15 to 1.55 km/s. Preferred example nanoenergetic materials show an electrostatic discharge ignition sensitivity reduction of nearly an order of magnitude through the incorporation of FGS.

Preferred method of the invention provide highly reactive $Bi_2O_3/Al$ energetic nanocomposites using FGS as a self-assembly directing agent. The FGS supports combustion enhancement through beneficial properties such as a high enthalpy of combustion (7.84 kcal/g for carbon-oxygen), large surface area, and exceptional optical and thermal characteristics that promote radiative heat transfer, and greater thermal conductivity within the nanocomposite. Method of the invention provide specific protocols that employ FGS for directing the formation of layered $Bi_2O_3$/Al/FGS nanostructures that ultimately coalesce into ultra-dense macrostructures assembled from the nanostructured $Bi_2O_3$/Al/FGS constituents. The self-assembly process is facile, spontaneous, and does not utilize surfactant chemistry, which can unfavorably hinder reaction kinetics by extending heat and mass transfer lengths.

In preferred methods, self-assembly is initiated through electrostatic forces provided by the complementary surface charges of $Bi_2O_3$, Al, and FGS dispersed in aqueous media. Long range electrostatic attraction leads to short range Van der Waals interactions and chemical bonding to complete self-assembly.

More generally, other energetic nanomaterials can be utilized if the surface charge of the energetic nanomaterial can be tailored in suspension to self-assemble with FGS. Tailored surface charge can be accomplished by chemically modifying surfaces of a particular energetic nanomaterial with functional groups. Fischer and Grubelich provide an analysis of the energy of many metal and oxide energetic nanomaterials. See, Fischer, Sh H., and M. C. Grubelich, "Theoretical energy release of thermites, intermetallics, and combustible metals," No. SAND--98-1176C; CONF-980728--. Sandia National Labs., Albuquerque, N. Mex. (1998). Fuel and oxidizer pairs can be selected according to desired properties (such as flame temperature, gaseous product evolution, density, energy content, ignition sensitivity, reactivity), and can be modified to have a complementary surface charge in suspension to FGS and self-assemble in accordance with the present invention. For example, alternative fuel and oxidizer nanoparticles of interest could include iodopentoxide, silicon, lithium, iron oxide, cupric oxide, boron, and others. To use alternative nanoparticles, the surface charge of these nanoparticles in suspension must be quantified and if it is not inherently complementary to FGS (opposite in polarity to facilitate electrostatic attraction) the surface charge of the nanoparticles can be modified through the adsorption of polymer coatings such as polyelectrolytes and self-assembled monolayers, or by modifying the number and magnitude of charged species in the colloid by adjusting the solution pH or through the addition of ionic salts. In this fashion, alternative nanoparticles beyond $Bi_2O_3$ and Al can be self-assembled using FGS. Preferred embodiments of the invention provide a simple, inexpensive and surfactant-free process for directing the self-assembly of $Bi_2O_3/Al$ nanocomposites using FGS as a self-assembly inducing agent. Electrostatic attraction between complementary charged $Bi_2O_3$, Al, and FGS in aqueous environments produces nanostructured assemblies of FGS chemically bound with densely packed $Bi_2O_3$ and Al nanoparticles. $Bi_2O_3$/Al/FGS nanostructures further assemble into ultra-dense, highly reactive macrostructures with substantially improved combustion performance in comparison to randomly mixed $Bi_2O_3/Al$. Enhancements in pressure generation, reactivity, and ignition sensitivity control were demonstrated in experiments and depend upon the percentage incorporation of FGS in the nanocomposites.

In additional embodiments, FGS can also be molecularly rendered with energetic functional groups such as nitro ($—NO_2$) and amine ($—NH_2$) to support further combustion enhancements. Energetic nanocomposites of the invention provide the basis for multi-functional, high performance combustion systems.

Preferred embodiments of the invention will be described with respect to the drawings and experiments that were conducted to demonstrate the preferred embodiments. Artisans will appreciate broader aspects of the invention from the description of preferred embodiments and experiments.

Figure 1B:
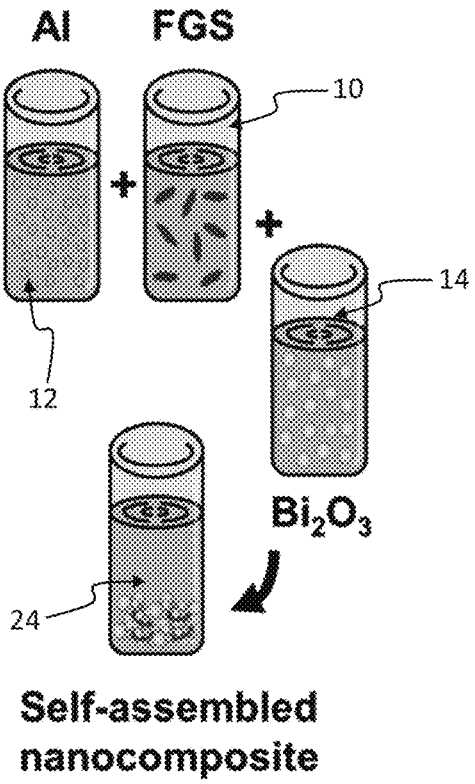

FIGS. 1A and 1B illustrate a preferred method for self-assembly of a $Bi_2O_3$, Al, and FGS nanocomposite. FGS is dispersed 10 in solution, such as via an ultrasonic dispersion. Fuel (Al in this example) and oxidizer ($Bi_2O_3$) are also dispersed 12, 14 in solution. To initiate self-assembly, fuel (Al) suspensions were added to the FGS suspensions and ultrasonically mixed 16 for a predetermined time that allows a fully dispersed solution of Al and FGS. The lack of visible precipitant in the solution is a good indication of full dispersion. Full dispersion was reached in a relatively short time, e.g., 1 h, in experiments. This produces a solution 18 that includes fuel covalently bonded to FGS. In the experiments, covalent chemically bound FGS-Al nanocomposites were formed. The existence of covalent chemical bonding between FGS and Al nanoparticles was confirmed through x-ray photoelectron spectroscopy analysis. Oxidizer ($Bi_2O_3$) suspensions are then mixed with the fuel/FGS suspensions and ultrasonically agitated for a time to allow proper dispersion of the Al-FGS and $Bi_2O_3$ nanoparticles to facilitate a robust self-assembly process. The exact time required for robust self-assembly will depend on a number of factors. Example factors include the concentration of nanoparticles, ultrasonic energy/frequency of the dispersion technique, and the solution volume. Example experimental times were 1 h ultrasonic agitation when Bi2O3 dispersions were added to Al-FGS dispersions. Suspensions are then removed from the ultrasonic bath and left undisturbed 22 for a time period. A self-assembly process occurs and completes the nanocomposite 24, and the nanocomposite continues to coalesce after formation. The process of FIGS. 1A and 1B can also be modified by mixing the oxidizer and the FGS first and the fuel afterward, and also be mixing the oxidizer, fuel and FGS in a single step before mixing, such as via ultrasonic mixing. The energetic nanocomposites are collected and dried to provide an energetic nanocomposite. In a preferred collection, the suspension agents are decanted after precipitation and the solids are dried under heat and vacuum. Care must be taken to avoid any conditions that could lead to ignition during the recovery of the nanoenergetic composites.

Experiments

Overview and Performance Advantages

Experiments were conducted to test the dynamics of the self-assembly process. The experiments included microscopic imaging, particle size analysis, zeta potential measurements, and chemical spectroscopy. The combustion performance of self-assembled $Bi_2O_3$/Al/FGS nanocomposites was also tested and data obtained concerning to pressure generation, burn rate, and ignition sensitivity. The performance of nanocomposites of the invention was compared to randomly mixed $Bi_2O_3$/Al and pronounced performance advantages were observed with respect to all performance categories, showing a dependence upon the percentage of FGS.

A significant increase of specific impulse by 61% was realized with the addition of 5 wt. % GO (with respect to the total weight of the nanocomposite) in comparison to that obtained for a control sample of neat $Bi_2O_3$/Al nanothermite without FGS. In the particular example, $Bi_2O_3$ and Al comprise 95% of the weight, while FGS is the remaining 5%. The weight in the final energetic nanocomposite is a function of the weight percentage of materials prior to reaction, and can be controlled with modification of the relative percentages of materials prior to reaction. Higher values of specific impulse can be provided by optimization of equivalence ratio. Another technique to increase impulse is to provide a nozzle geometry in forming a specific combustion device.

Nanocomposites of the invention benefit from properties of FGS, which include high energy density (heat of reaction in air=32.8 kJ/g), large surface area, decomposition of functional groups into low molecular weight gaseous products, negligible combustion residue, and appealing thermal, electrical and mechanical properties. The chemical functionality of graphene can also be tailored at the molecular level with energetic groups such as nitro (—$NO_2$) and amine (—$NH_2$), to further allow predetermination and tuning of impulse engineering properties of nanocomposites of the invention.

Al and $Bi_2O_3$ were selected as the fuel and oxidizer for the experiments. The fuel and oxidizer provide excellent combustion properties including a fast burn rate, high density, and large gas production by weight. Al nanoparticles (80 nm average diameter) and $Bi_2O_3$ nanoparticles (90 to 210 nm average diameter) were purchased and used as received from Novacentrix and Accumet Materials respectively. FGS in the form of graphene oxide was synthesized from graphite nanoplatelets (XG Sciences) through the modified Hummer's method. Graphene oxide (GO) is defined as a type of FGS with many oxygen containing functional groups and a C/O ratio of ~2. The density of oxygen containing functional groups in GO provides numerous binding sites to self-assemble $Bi_2O_3$ and Al nanoparticles. Spectroscopic studies of the FGS revealed a large number of smaller $sp^2$ carbon domains (associated with defects), a C/O ratio of 2.3, and the presence of hydroxyl, carbonyl, and carboxylic acid functional groups. Some self-assembly was observed with the use of RGO and AG, but not to the extent provided by GO. The main factors are the various surface functionalities (GO has a lot more oxygen containing functionalities than AG or RGO) and surface potential of the various types of graphene in colloidal suspension. The AG and RGO self-assembly processes require modification to function well. To modify the surface potential and provide a better reaction, steric or electrostatic techniques can be used.

The order of constituent mixing and timing for various steps in the FIGS. 1A and 1B process were tested in experiments. The effects of constituent mixing order on the self-assembly process were tested by mixing $Bi_2O_3$ with FGS first (as opposed to initially mixing Al with FGS) or to adding $Bi_2O_3$ and Al to FGS simultaneously. The three processes yielded very similar self-assembled structures. However, the self-assembled microstructural features of composites of the invention observed with TEM are different from each other, indicating that the interaction force between the various ingredients is influenced by the order of adding the ingredients. Experimental data discussed below was acquired from nanocomposites prepared using order of FIGS. 1A and 1B. The experiments demonstrated excellent performance. Further enhancements of performance are expected from replacing the oxygen functional groups such as hydroxides with more energetic groups such as nitro- and amine groups, which would create more gas generation and therefore better combustion performance.

The experiments tested the dynamics of self-assembly for five $Bi_2O_3$/Al nanocomposites prepared with FGS contents ranging from 0.0% (randomly mixed control) to 5.0% FGS by weight and are identified as $Bi_2O_3$/Al/FGS(X %), where X denotes FGS weight percentage. Calculated amounts of FGS were first dispersed in a solution of dimethylformamide (DMF) at 0.5% weight/volume (w/v) concentrations using an ultrasonic bath for X h. Simultaneously, $Bi_2O_3$ and Al in x and x % w/v concentrations respectively were ultrasonically dispersed in 1:1 volume ratio suspensions of DMF and isopropanol (IPA) for X h. The relative weights of $Bi_2O_3$ and Al correspond to an equivalence mixing ratio of 1.0 (not adjusted for FGS additives), selected for optimized combustion kinetics. Generally, optimized combustion kinetics range from stoichiometric to slightly fuel rich (equivalence mixing ratio of 1.0 to 2.0), though the exact optimum value depends on the nanoenergetic material used and experimental conditions. Guidance can be found in various publications. See, e.g., Shende, R.; et al., "Nanoenergetic composites of CuO nanorods, nanowires, and Al-nanoparticles," Propellants, Explos., Pyrotech. 33, 122-130 (2008); Bezme-Initsyn, A. et al., "Modified Nano energetic Composites with Tunable Combustion Characteristics for Propellant Applications," Propellants, Explos. Pyrotech. 35, 384-394 (2010). Zeta potential was measured to quantify particle surface charge in the precursor suspensions and average values of +70.14 mV, +39.71 mV, and −58.57 mV for Al, $Bi_2O_3$, and FGS suspensions, respectively, were obtained. The surface charge polarities between the Al, $Bi_2O_3$, and FGS have potential for electrostatic attraction, which experiments confirmed play a prominent role in the self-assembly process.

The single constituent and nanocomposite suspensions were observed after remaining undisturbed for 18 h following ultrasonic agitation. Constituent suspensions of exclusively $Bi_2O_3$, Al, or FGS were still well dispersed after 18 h, but all nanocomposite suspensions exhibited solid phase separation from the suspension medium. $Bi_2O_3$/Al suspensions remained dispersed for several hours until the selective precipitation of $Bi_2O_3$ occurred as verified by distinct yellow ($Bi_2O_3$) and gray (Al) regions. Al suspensions remained dispersed for several days. The solid phase separation of $Bi_2O_3$ from Al is likely due to the higher density of $Bi_2O_3$ relative to Al and electrostatic repulsion between the similarly charged particles that prevents self-assembly. Inter solid phase separation is highly undesirable for nanocomposite energetic materials as it will reduce fuel and oxidizer interfacial contact and lead to poor and unreliable combustion performance. In contrast, nanocomposite suspensions containing FGS exhibited homogenous solid phase precipitation within much faster times ranging from minutes to hours dependent on FGS content. The precipitate from all $Bi_2O_3$/Al/FGS suspensions was uniformly dark green and implied the precipitation of all solid phases occurred simultaneously as the dark green color signifies an amalgamation of yellow and gray. Nanocomposites with higher FGS content (>3.5%) exhibited complete solid phase precipitation within 1 to 2 minutes, while lower FGS content nanocomposites (<2%) fully precipitated within 24-36 hours. The uniform precipitate color and fast settling times for the nanocomposite suspensions containing FGS provide evidence of self-assembly. With the particular experimental process conditions, FGS content greater than 10% by weight failed to produce self-assembly. The limit of FGS can vary with other nanoenergetic materials and other FGS. The limiting factor in the example experiments was that the negative surface potential of the FGS at this high of a concentration prevented self-assembly by stabilizing the nanocomposites in suspension. Engineering the surface charges of the FGS, the fuel and the oxidizer can permit higher concentrations of FGS.

Particle size analysis of the nanocomposite suspensions was performed using dynamic light scattering (DLS) characterization. Al and $Bi_2O_3$ featured unimodal particle size distributions with average hydrodynamic diameters of 110 nm and 137 nm respectively. FGS showed a bimodal particle size distribution with a small mode average diameter of 465 nm and large mode average diameter of 10 μm. Suspensions of Al mixed with FGS yielded another bimodal particle size distribution, but with larger average hydrodynamic diameters in comparison to the constituent FGS suspension of 909 nm and 35 μm for small and large modes respectively. Lastly, a bimodal particle size distribution was observed for $Bi_2O_3$/Al/FGS (5%) with the largest average hydrodynamic diameters for all the suspensions of 951 nm and 50 μm. DLS measurements verified self-assembly of the FGS to Al and $Bi_2O_3$ by the considerable increase in hydrodynamic diameters of the $Bi_2O_3$/Al/FGS in comparison to the constituent samples.

Graphene size was also measured. The graphene sheets are a few nm in thickness and a couple microns in diameter. Specifically, average thicknesses were 0.6-1.2 nm thickness which corresponds to 1-3 layers of graphene. Typical surface area was 101 $m^2/g$, which was measured using BET nitrogen isotherm adsorption. DLS particle size analysis showed a bimodal size distribution (two average diameters) for graphene oxide sheets of 840 nm and 10 μm. DLS measures the hydrodynamic diameter of graphene sheets in suspension (which is larger than the physical diameters of the graphene sheets). However, comparison of AFM imaging of the graphene oxide sheets with the DLS data shows agreement in the measurements.

Figure 2A:
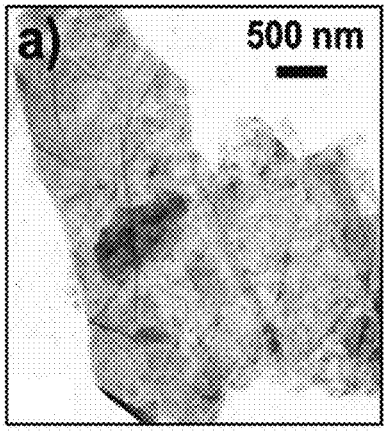
FIGS. 2A-2D are SEM images and FIGS. 2E-2F are TEM images of constituents and $Bi_2O_3$, Al, and FGS nanocomposites, where
Figure 2B:
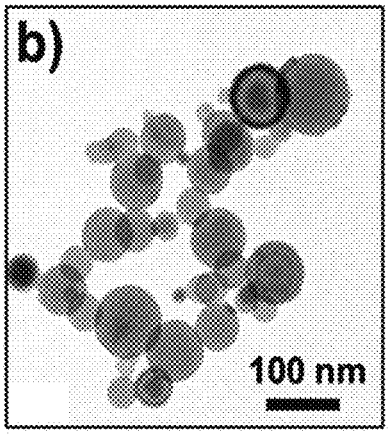
Figure 2C:
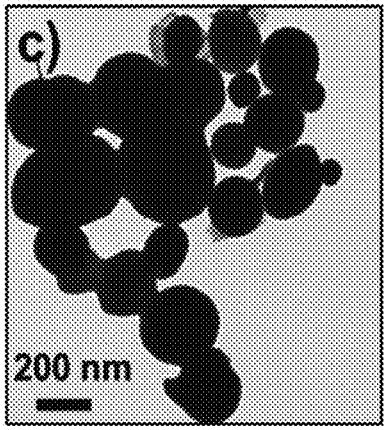
Figure 2D:
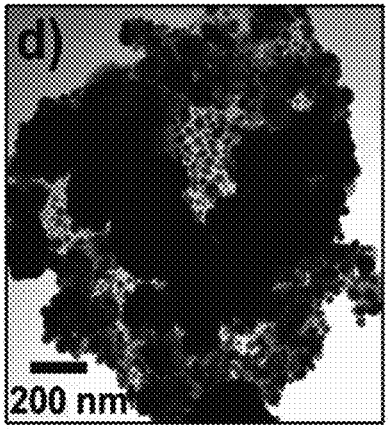
Figure 2E:
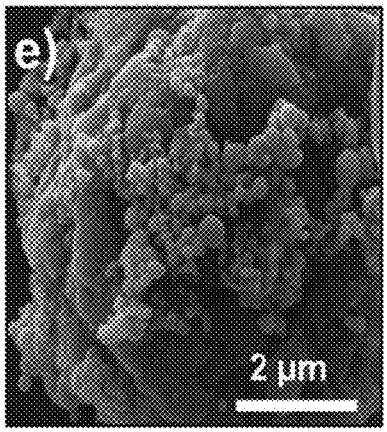
Figure 2F:
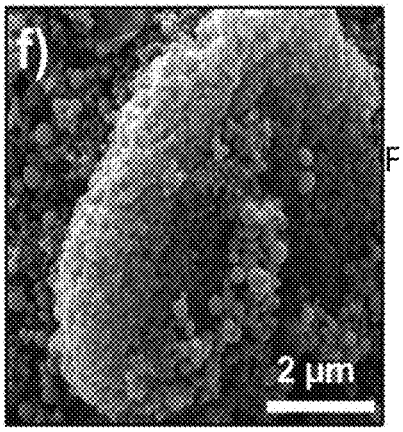
Figure 2G:
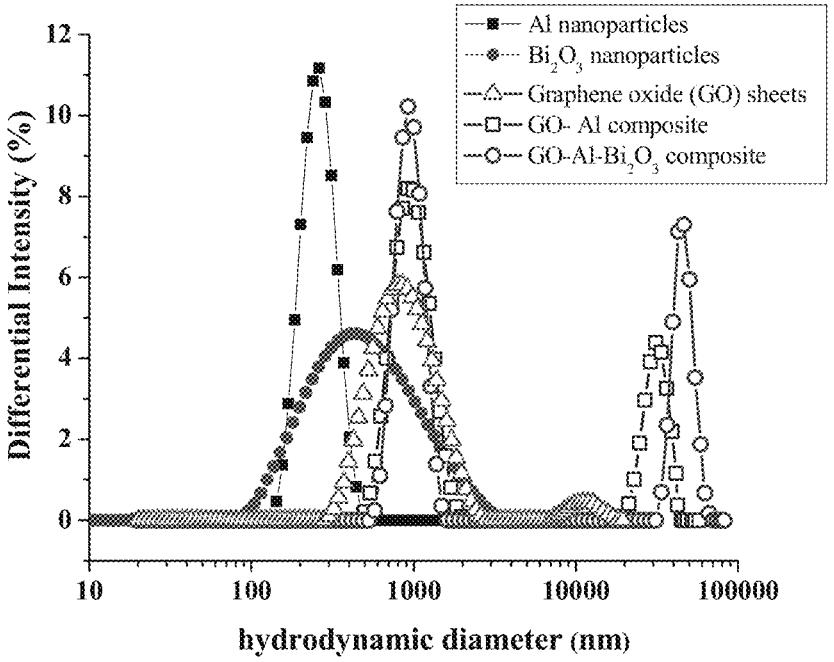
FIG. 2G plots differential intensity as a function of hydrodynamic diameter for $Bi_2O_3$,/Al/FGS macrocomposites.

Transmission and scanning electron microscopy (TEM and SEM) was performed to characterize the physical structures of the individual constituents and the nanocomposites. FIGS. 2A-2F show the images. High magnification TEM showed layered, self-assembled, nanostructures consisting of FGS sheets top and bottom decorated with densely packed $Bi_2O_3$ (dark contrast) and Al (light contrast) nanoparticles FIG. 2D. Lower magnification SEM revealed the formation of ultra-dense macrostructures with dimensions larger than a few tens of microns that were formed of $Bi_2O_3$/Al/FGS nanostructures further assembled in both layered FIG. 2E and random FIG. 2F orientations. The shapes and size distributions of both the constituents and nanocomposites visualized through electron microscopy agreed well with DLS particle size analysis. The orientation of the $Bi_2O_3$/Al/FGS nanostructures within the large macrostructures appeared to be driven by the two particle size modes where smaller sized, less planar (less 2-D) $Bi_2O_3$/Al/FGS formed randomly oriented macrostructures and larger sized, more planar (more 2-D), $Bi_2O_3$/Al/FGS tended to coalesce into layered macrostructures. This is represented in FIG. 2G where the smaller, less planar energetic macrostructures were ~1000 nm. The larger, more planar microstructures were ~50,000 nm. The more planar (more 2-D) structures are preferred for a "stacking" effect that is produced.

The macrostructure assembly orientation likely arises from electrostatic interactions between the $Bi_2O_3$/Al/FGS nanostructures, where larger, more two-dimensional $Bi_2O_3$/Al/FGS would be more likely to geometrically align with one another prior to assembling. Regardless of macrostructure organization, the $Bi_2O_3$/Al/FGS nanostructured building blocks facilitated excellent heterogeneous particle intermixing and their self-assembly into highly dense macrostructures. This provides nanocomposite energetic materials with enhanced reaction kinetics.

Figure 3A:
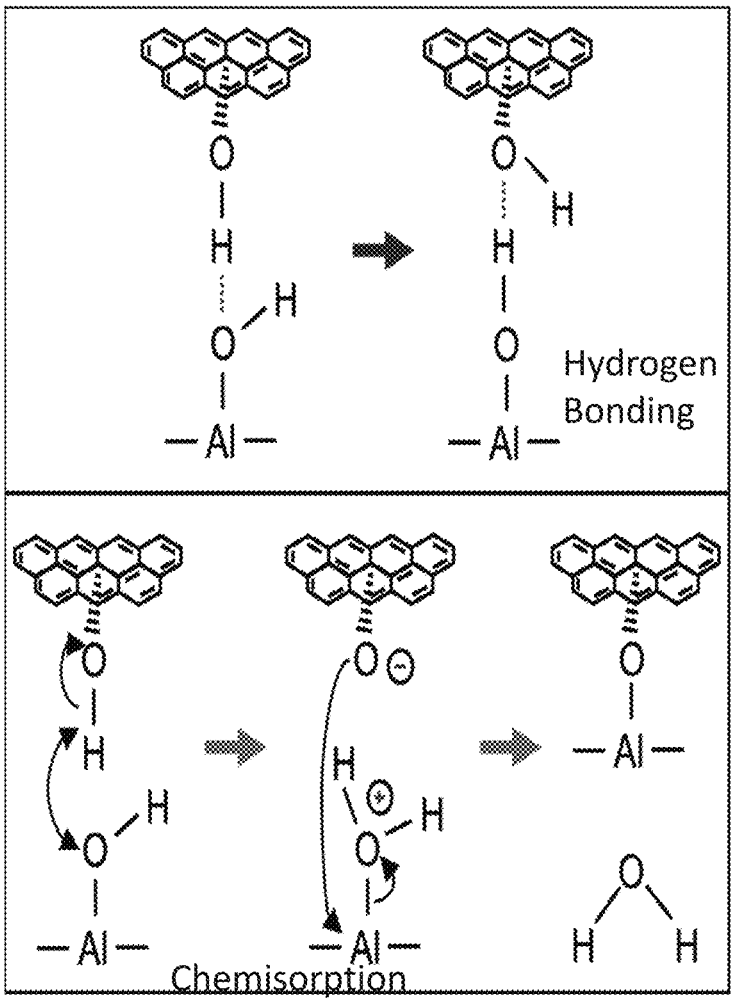
FIG. 3A shows chemical bonding mechanisms for self-assembly methods of the invention.
Figure 3B:
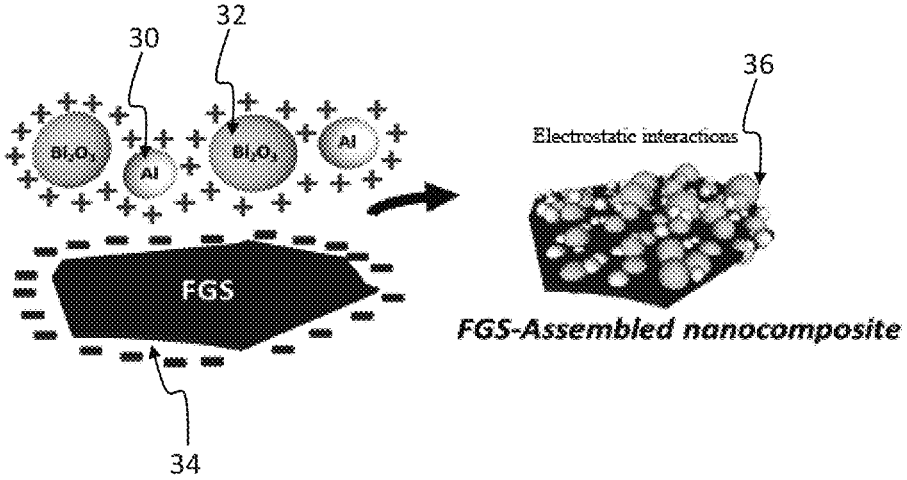
FIGS. 3B-3C graphically illustrate energetic $Bi_2O_3$/Al/FGS nanocomposites of the invention.

While not necessary to practice the invention, and without being bound by the theory, the dynamics of $Bi_2O_3$/Al/FGS self-assembly are likely driven by three distinct mechanisms that occur at various length scales. First, the complementary surface potentials of $Bi_2O_3$, Al, and FGS particles (respectively +40 mV, +70 mV and −59 mV) in suspension lead to long range electrostatic attraction to begin the self-assembly process. Specifically, complementary surface charge (opposite polarity) between Al, $Bi_2O_3$ and FGS initiates the self-assembly process through electrostatic attraction. Other fuel and oxidizer energetic nanomaterials that show similar complementary surface charge to FGS in suspension (positive polarity) are also expected to self-assemble. Once Al or $Bi_2O_3$ migrate close enough to the oppositely charged FGS, shorter range Van Der Waals interactions likely govern the assembly process as they become the dominant force over electrostatic attraction. After this, hydrogen or covalent bonding of the Al or $Bi_2O_3$ to the FGS can occur. The chemical bonding mechanisms are illustrated in FIG. 3A and FIG. 3B is an illustration of the bonding and the form of the synthesized energetic nanocomposite.

Figure 3C:
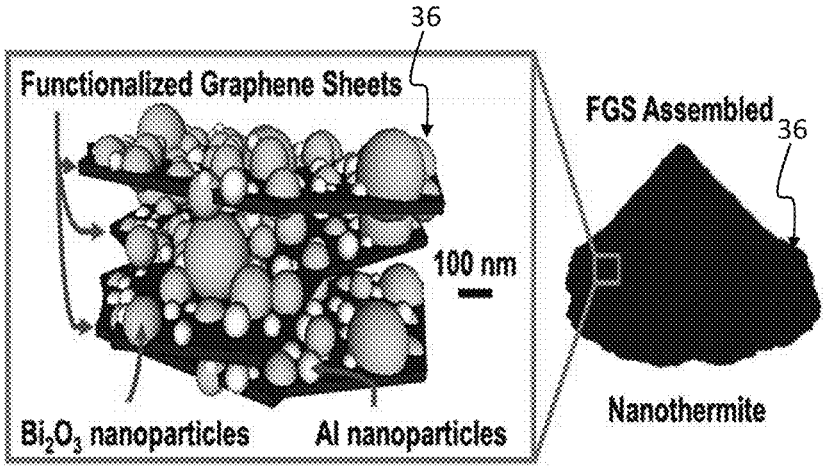

The surface chemistry of FGS, Al, and $Bi_2O_3$ nanoparticles play an important role in the chemisorption and physisorption process between the nanothermite nanoparticles and the functionalized graphene. Aluminum oxide surfaces have been shown to adsorb chemically and physically to alcohol molecules. In chemisorption with GO as the FGS, the hydroxyl group of the GO reacts with the hydroxyl group of the metal oxide, as shown in FIG. 3A. In addition, physisorption is expected to occur via hydrogen bonding between the hydroxyl group of the Al nanoparticle surface and the functionalized graphene. Chemical bonding of Al or $Bi_2O_3$ to FGS can take place at any of the oxygen containing function groups available on the FGS due to the hydroxylated oxide surfaces of both the $Bi_2O_3$ and Al. The Al nanoparticles used in the experiments is passivated with a 2-3 nm aluminum oxide shell and a Fourier transform infrared spectroscopy spectrum indicates the existence of hydroxyl groups by a large broad peak at 3700-3200 $cm^{-1}$. Aluminum oxide is known to physisorb with alcohols through hydrogen bonding. Additionally, Aluminum oxide has been reported to covalently bond with alcohols where an alkoxide forms and covalently bonds with a surface Al cation while eliminating a water group. The oxygen containing functional groups on FGS act identically as alcohols and can thus facilitate both types of chemical bonding. The mechanisms of Al chemical bonding to the FGS similarly apply to the $Bi_2O_3$ nanoparticles. The experiments and knowledge of the inventors tend to support a conclusion that the highly dense packing of $Bi_2O_3$ and Al nanoparticles on FGS arises from the large packing density of oxygen containing functional groups on the FGS as verified by spectroscopic studies. As illustrated in FIGS. 3B-3C, the bonding processes closely associate nano fuel particles 30 and oxidizer particles 32 with FGS sheets 34 to form an energetic nanocomposite 36 of the invention.

FGS directed self-assemblies of the invention were also tested for combustion performance. Dried $Bi_2O_3$/Al/FGS nanocomposite powders were harvested by decanting their suspension agents after precipitation and drying the solids at 65° C. under rough pumped vacuum for 20 h. Randomly mixed $Bi_2O_3$/Al control samples were collected by drying well dispersed suspensions of $Bi_2O_3$ mixed with Al at 65° C. and ambient pressure for 20 h. The combustion kinetics of the nanocomposites were investigated versus FGS content (from 0% to 5%) with respect to pressure generation, pressurization rate, and linear burning rate. Pressure generation measurements were taken by initiating $Bi_2O_3$/Al/FGS nanocomposites loaded at ~15% theoretical maximum density (TMD) in a 60 $mm^3$ closed pressure cell equipped with a pressure transducer (PCB model 119B12). Data acquired from pressure generation measurements included peak pressure generated and pressurization rate (dP/dt), which was calculated using standard procedures. Linear burn rate measurements were obtained using an optical photodiode array mechanically affixed to a Lexan burn tube with 3.2 mm inner dia. and 101.6 mm length. Nanocomposites were loaded in the burn tubes at ~4% TMD, initiated at one end, and the light emitted from the reaction sequentially triggered photodiode responses in the array to enable a velocity calculation. A minimum of three tests under identical experimental conditions were administered for all combustion measurements to acquire experimental error bars and ensure the validity of performance trends.

Figure 4A:
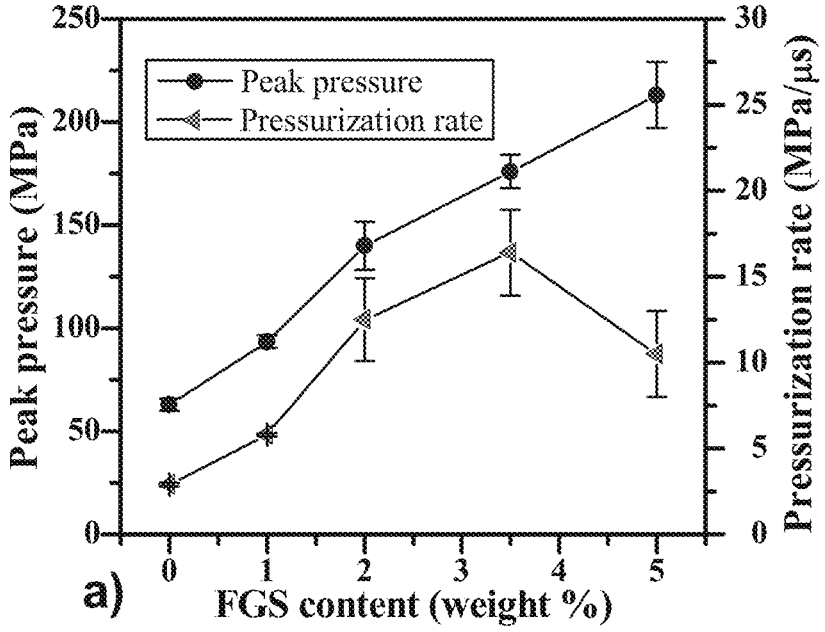
FIGS. 4A and 4B illustrate pressures generated, pressurization rates, and linear burning rates of example experimental $Bi_2O_3$/Al/FGS nanocomposites as a function of FGS content.
Figure 4B:
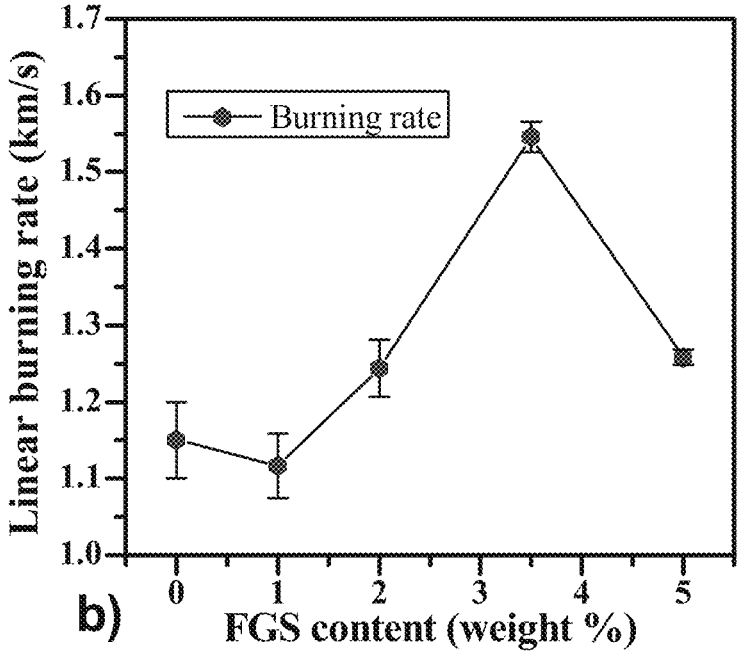

The pressures generated, pressurization rates, and linear burning rates of the $Bi_2O_3$/Al/FGS nanocomposites as a function of FGS content are shown in FIGS. 4A and 4B. The peak pressures generated in the closed pressure cell measurements steadily increased with greater FGS content from ~60 MPa to 200 MPa for $Bi_2O_3$/Al and $Bi_2O_3$/Al/FGS (5%) respectively. Some reduction is expected past 5% graphene, though the self-assembly process will continue with higher percentages, as discussed above. As its percentage increases, graphene should be accounted for in the equivalence mixing ratio calculation, otherwise reaction kinetics will reduce. Pressurization rate, a gauge of reactivity, also increased with FGS content for nanocomposites with up to 3.5% FGS from 2.9 to 16.4 MPa/μs, but a reduction in pressurization rate was observed for nanocomposites with 5% FGS to 10.5 MPa/μs. Linear burning rate measurements exhibited a similar trend as pressurization rate where a maximum average burn rate of 1.55 km/s was measured for $Bi_2O_3$/Al/FGS (3.5%) in comparison to 1.15 km/s for physically mixed $Bi_2O_3$/Al and 1.26 km/s for $Bi_2O_3$/Al/FGS (5%).

The data support that FGS content and increasing peak pressure can be attributed to the greater gaseous species production and larger energy content for nanocomposites with more FGS. Other testing also supported this conclusion.

The data show benefits of the present FGS directed self-assembly, particularly a substantial enhancement in pressurization rate and linear burning rate for nanocomposites with up to 3.5% FGS content in comparison to randomly mixed $Bi_2O_3$/Al. There is also a continued enhancement in peak pressure that continued through the 5.0% FGS content. The $Bi_2O_3$/Al/FGS (5%) nanocomposites showed a decline in pressurization rate and burning rate, even though it was expected that these nanocomposites would feature a maximum degree of self-assembly. Reduced reaction kinetics for $Bi_2O_3$/Al/FGS (5%) nanocomposites may be attributed to an equivalence mixing ratio imbalance, which offsets the benefits of self-assembly. FGS contains carbon, hydrogen, and oxygen atoms, all of which can participate as fuels and oxidizers in an energetic reaction. If there is too much fuel or too much oxygen within an energetic material, slower reaction rates are observed. At a 5% FGS weight concentration, the equivalence mixing ratio of the $Bi_2O_3$/Al/FGS nanocomposites should be adjusted to accommodate the FGS reactants and achieve optimized reaction kinetics.

The data from the experiments show that the dense, self-assembled nanostructures produced using FGS directed self-assembly of the invention ensured homogenous mixing and intimate interfacial contact between the fuel (Al) and oxidizer ($Bi_2O_3$) to enhance reactivity. The degree of self-assembly and thus $Bi_2O_3$ and Al nanoparticle packing density and intermixing is influenced by FGS content, where more FGS provided superior self-assembly. The reduced performance observed after 3.5% FGC likely resulted from an imbalance in the fuel-oxidizer mixing ratio. This should be kept in the range of 1.0-2.0 as discussed above, which is achievable at a given percentage of FGS when initial components are set carefully.

Figure 5:
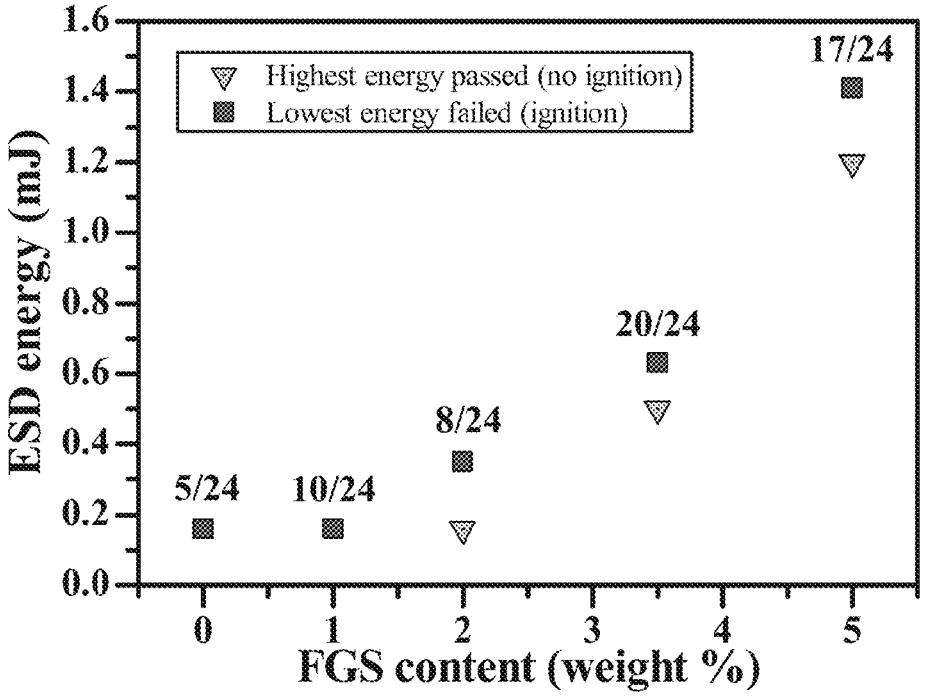
FIG. 5 illustrates electrostatic discharge (ESD) sensitivity of example experimental $Bi_2O_3$/Al/FGS nanocomposites as a function of FGS content.

The sensitivity of energetic materials to external ignition stimuli such as electrostatic discharge, impact, and friction events is an extremely important parameter in determining safe handling procedures and for engineering reliable ignition systems. Additional experiments evaluated the electrostatic discharge (ESD) sensitivity of $Bi_2O_3$/Al/FGS nanocomposites of the invention versus FGS content. ESD testing of $Bi_2O_3$/Al/FGS nanocomposites was conducted using a standardized system (ETS model 931) and in compliance with US military protocols. Nanocomposites were exposed to electrical discharge cycles at increasing energy levels (24 consecutive discharges at each energy level) until an ignition event was observed. In this fashion the threshold limits for ESD pass (no ignition) and ESD fail (ignition) were quantified by energy level. The pass/fail ESD sensitivity of the $Bi_2O_3$/Al/FGS nanocomposites is shown in FIG. 5. Generally, the data show that increasing FGS percentages provide reduced ESD sensitivity. Specifically, the nanocomposites with greater FGS content showed reduced ignition sensitivity to ESD events and $Bi_2O_3$/Al/FGS (5%) passed at 1.2 mJ, a nearly order of magnitude reduction in ESD sensitivity in comparison to randomly $Bi_2O_3$/Al. It is likely the low electrical conductivity of the FGS lowered the net electrical conductivity of the self-assembled nanocomposites, which inhibited conductive pathways for joule heating and consequentially reduced ESD sensitivity.

In contrast, randomly mixed $Bi_2O_3$/Al were extremely sensitive to ESD and failed at 0.16 mJ (the lowest ESD energy that can be produced by the system). Therefore in addition to facilitating self-assembly and supporting enhanced reaction kinetics, FGS proved to be a viable mechanism for engineering the ESD sensitivity of the self-assembled nanocomposites of the invention, which is a key design parameter of concern in combustion systems.

Experimental Procedures and Additional Nanocomposite Testing

Synthesis

Three types of functionalized graphene sheets (FGS) were synthesized graphene oxide (GO), reduced graphene oxide (RGO), and aminated graphene (AG) via a modified Hummer's method. Graphite nanoplatelets (1 g) and sodium nitrate (1 g) were mixed with 46 ml of concentrated $H_2SO_4$ in a beaker immersed in an ice bath. 6 g of potassium permanganate was added to the reaction mixture and the beaker was immersed in a water bath with a temperature of 35° C. for 1 hour. 40 ml of deionized water was added slowly, and the reaction mixture was heated in the water bath at 90° C. for 30 minutes. Afterwards, 200 ml of deionized water was added to the reaction mixture. 6 ml of hydrogen peroxide was added to the reaction mixture to turn the brownish material to a yellowish color. The material was then left to cool at room temperature. The material was centrifuged several times with deionized water to remove the impurities. The graphene oxide material was dispersed with water via sonication or mechanical stirring, placed on aluminum foil boat, and dried at 65° C. for 12 h. The graphene oxide was dried leaving a paper like material.

The RGO was synthesized by heat refluxing the graphene oxide with hydrazine monohydrate. GO was dispersed in some water via sonication, then some N,N-dimethylformamide (DMF) was added until the solvent consists of a mixture of 9:1 volume ratio of DMF:water. Hydrazine monohydrate (1 ml added for every 100 mg of graphene oxide) was added to the dispersion, and the dispersion was heat refluxed at 110° C. for 24 hours. The aminated graphene was synthesized via one-pot, solvothermal treatment of graphene oxide dispersed in ethylene glycol and reacted with the addition of ammonium hydroxide. In effect, the aminated graphene was also a form of reduced graphene but with amine groups (—NH2) decorating the sheet. Both forms of reduced graphene sheets are centrifuged and washed with DMF to get rid of any traces of water or impurities. The final form of the two chemically modified graphene sheets was dispersion in DMF, in which the concentration of the dispersion was determined by weighing the amount of graphene within a given volume of dispersion.

Nanocomposite Synthesis ingredients were dispersed in dimethylformamide (DMF) separately, after which dispersions of Al and $Bi_2O_3$ nanoparticles in iso-propanol (IPA) were added to FGS dispersions. Spontaneous precipitation of all solid components (homogeneously mixed) began to occur within a few minutes, when the dispersions were left undisturbed and the aggregates precipitated completely after several hours. The solvent was then decanted and the solids were dried at 65° C. in ambient or under vacuum. The color of the precipitate was uniformly dark green, suggesting that precipitation of the solid phase occurred simultaneously without any phase separation. Spontaneous aggregation and precipitation was observed in all samples.

Physical and Chemical Characterization

The physical properties (morphology, dimensions and surface area) and the chemical properties (chemical composition, type and amount of functional groups, C/O, C/N ratios) of FGS were characterized using a variety of analytical tools. The thickness and morphology of the FGS were measured with atomic force microscopy (AFM) and transmission electron microscopy (TEM). Image analysis characterized a majority of the GO and AG sheets as 0.6-1.2 nm thick, indicating single layered sheets. Though a majority of the GO and AG sheets synthesized were single layers, there were also a significant number of multi-layered sheets. Synthesized RGO yielded a thickness of approximately 2.6 nm suggesting the material was comprised of 3-4 layers. The lengths and widths of GO, RGO and AG proved to be a few hundreds nanometers in average dimension. The RGO and the AG were found to have some degree of wrinkling and folding of the sheets. The surface areas of GO, RGO and AG sheets measured using BET nitrogen adsorption method were 20 $m^2/g$, 336 $m^2/g$ and 653 $m^2/g$ respectively. However, the value of 20 $m^2/g$ measured for GO sheets appear to be small based on the analysis of AFM images that indicate GO sheets were primarily single layer sheets. It is believed that GO sheets may come together when dried as a powder, which would reduce the overall surface area. This is consistent with expectations, because surface area per unit mass of material is expected to reduce as a result of the self-assembly process because of the addition of dense (relative to graphene) nanoparticle spheres to the material and because the fuel and oxidizer nanospheres have the lowest surface area per unit volume of any shape. As noted above, the surface areas of GO, RGO and AG sheets measured using BET nitrogen adsorption method were 20 $m^2/g$, 336 $m^2/g$ and 653 $m^2/g$, respectively. Functionalized surface areas were typically 653 $m^2/g$ after functionalization via treatment with a 1:3 volume mixture of nitric and sulfuric acid, followed by extensive washing.

Fourier transform infrared (FTIR) absorption spectra of GO, RGO and AG show the presence of various functional groups such as hydroxyl, epoxy, carbonyl and carboxylic acid groups with different concentrations dependent upon the type of FGS synthesized. Analysis (Table 1) of the data obtained from X-ray photoelectron spectroscopy (XPS) confirms that the C/O atomic ratio for GO was 2.3, whereas the C/O atomic ratio for RGO was 9.0.

TABLE 1

Properties of FGS Samples Formed

| Sample | Surface Area ($m^2/g$) | C/O atomic ratio | C/N atomic ratio |
|---|---|---|---|
| Graphite Nanoplatlets | Not known | 83 | NA |
| Graphene Oxide | 20 | 2.3 | NA |
| Reduced Graphene Oxide (RGO-80° C.) | 336 | 3 | 27.8 |
| Reduced Graphene Oxide (RGO-110° C.) | Not performed | 9 | 9.4 |
| AG | 653 | 9.2 | 10.7 |

The AG had a C/O atomic ratio of 9.2 and C/N atomic ratio of 10.7. Micro-Raman measurements were conducted to understand the quality of the synthesized FGS. All the graphene samples exhibited four characteristic bands. A D band is associated with defects. A D+G peak is the combination of the D and G peak. The most dominant bands of graphene are the G and 2D peak, which relates to the phonon vibrational modes of the $sp^2$ carbon lattice. The relatively high intensity ratio of D peak to G ($I_D/I_G$) with a value of around 1.0 determined for FGS confirmed the presence of a large number of smaller $sp^2$ carbon domains caused by large number of defects.

Electron microscopic examination of various composites indicated that self-assembly was more pronounced in case of composites formed using GO, and less so in case of composites formed using AG and RGO. In particular, the typical TEM images of GO based self-assembled composite reveal that the Al and $Bi_2O_3$ nanoparticles bind close to each other onto the GO sheets and these composites are very dense. Some experiments showed that AG- and RGO-based composites did not assemble, but tailoring the composition by incorporating more energetic groups such as amine- and nitro-functionalized groups is expected to aid the assembly.

Control samples of $Bi_2O_3$ and Al dispersed in IPA did not show any formation of aggregates, and therefore no spontaneous precipitation occurred. Additionally, in the control samples, $Bi_2O_3$ nanoparticles tend to precipitate slowly, resulting in phase separation from Al fuel. This is undesirable as such phase separated material exhibits poor, unreliable and irreproducible combustion performance. Experiments showed that incorporation of even 0.5 wt. % FGS in the control samples comprising of $Bi_2O_3$/Al nanothermites helps to avoid the phase separation, which reflects the significance of FGS in these nanoenergetic formulations.

Optimized Energetic Nanocomposites

Zeta potential is a physical characteristic exhibited by any particle in a suspension that arises primarily due to the presence of charges on the particle. The zeta potential value can be used to prepare optimized formulations for stable dispersions with long term stability. This plays an important role in the homogeneous dispersion of agglomerated dried nanoparticles. Generally, suspensions with zeta potential above 30 mV (absolute value) are physically stable. Suspensions with a potential above 60 mV show excellent stability. Suspensions below 20 mV are of limited stability; below 5 mV they undergo pronounced aggregation. The present inventors concluded from experiments with GO-based dispersions that the extent and the kinetics of self-assembly of nanothermite on FGS are strongly dependent on the stability of FGS dispersions. Higher stability and exfoliation of neat FGS in solvents provides a higher possibility of assembly of Al and $Bi_2O_3$ nanoparticles on FGS, which leads eventually to the formation of high dense, self-assembled nanoenergetic materials. Testing confirmed the self-assembly of graphene oxide/Al/$Bi_2O_3$ with respect to zeta potential measurements. The data obtained from zeta potential measurements on various dispersions of GO, Al, $Bi_2O_3$, GO/Al, GO/$Bi_2O_3$ and GO/$Bi_2O_3$/Al are summarized in Table 2

TABLE 2

Summary of Zeta Potential Values.

| Material System | Zeta potential (mV) |
|---|---|
| Graphene oxide | −35.38 |
| Al | 38.71 |
| $Bi_2O_3$ | 22.60 |
| Graphene oxide/Al | −19.21 |
| Graphene oxide/$Bi_2O_3$ | −13.07 |
| Graphene oxide/Al/$Bi_2O_3$ | 0.80 |
| Al/$Bi_2O_3$ (control sample) | 65.30 |

Based on the above definitions of stable (unlikely to aggregate and precipitate from suspension) and unstable suspensions, the neat GO, $Bi_2O_3$ and Al dispersions with absolute zeta potential values in the range of 20-40 mV (by themselves), and are stable to a reasonably long time, i.e. long enough to permit the self-assembly process to occur. The materials in the experiments have the following stabilities: $Bi_2O_3$ is stable for approximately 4 h, Al nanoparticles for days to months and GO for days to months. These measurements indicate that while the surface of GO is negatively charged, the surfaces of Al and $Bi_2O_3$ nanoparticles are positively charged, providing the possibility of electrostatic interactions that could force spontaneous aggregation of fuel/oxidizer nanoparticles. Experiments showed that adding Al or $Bi_2O_3$ dispersions to GO dispersions reduces the zeta potential below absolute 20 mV, which indicates instability. The combination of GO, Al, and $Bi_2O_3$ nanoparticles reduced zeta potential to 0.8 mV, providing evidence of the self-assembly aggregation. In contrast, the neat control sample containing Al and $Bi_2O_3$ exhibits high zeta potential value of 65.3 mV, showing stability and a lack of self-assembly.

The present inventors attribute the difference in the chemistry in terms of the nature of functional groups present in these three types of FGS and their amounts as causing less dense self-assembled composite formation in case of AG and RGO-based formulations, which was also revealed in TEM images. The zeta potential for the AG and RGO-based formulations can be adjusted, for example by steric or electrostatic techniques to provide better self-assembly that is comparable to the results realized for the GO formulation. As an example steric technique, thin polymer coatings can change functionalities of the materials to have more favorable interactions with the suspension agent and greater repulsive force between the particles. An electrostatic technique can add a salt to the solution to change the concentration of ions.

Dynamic Light Scattering

Experiments used this technique to characterize the constituents and the nanocomposites. An increase of hydrodynamic size is consistent with higher levels of self-assembly. The results are shown in Table 3. The hydrodynamic size distribution for graphene oxide consisting of an average of 9.77 μm composes about 90 weight % of the sample of graphene oxide but <10% by number. When graphene oxide is self-assembled with Al nanoparticles, the self-assembled nanostructure is found to have a hydrodynamic size distribution of 42.4 μm, which consist of >90 wt. % of the sample of GO/Al. For the greatest hierarchical level of self-assembly involving GO/Al/$Bi_2O_3$, the hydrodynamic size is measured to be 50.4 μm, which also consists of >90 wt. % of the sample. In both cases of GO/Al and GO/Al/$Bi_2O_3$, the size distribution by weight is governed primarily by GO size distribution with an average of 9.77 μm. Hierarchical levels of self-assembly are confirmed by the observed increasing hydrodynamic sizes starting from GO and ending with GO/Al/$Bi_2O_3$.

TABLE 3

Measurement of hydrodynamic size distributions

| Dispersion | Hydrodynamic Size (avg. size ± std. dev.) | Hydrodynamic Size Distribution |
|---|---|---|
| Al | 110.4 nm ± 31.6 | |
| $Bi_2O_3$ | 136.8 nm ± 39.1 | |
| GO | 464.7 nm ± 118.6 | 322.6-1596.3 nm (>99% by number) |
| | 9.8 μm ± 1.4 | 7.9-12 μm (89% by weight) |
| Al/$Bi_2O_3$ | 83.4 nm ± 22.0 | |
| | 42.4 μm ± 11.1 | |
| GO/Al | 405.6 nm ± 87.3 | 29.5-195.1 μm (>99% by weight, 23% by number) |
| | 3.3 μm ± 0.891 | |
| GO/Al/$Bi_2O_3$ | 50.4 μm ± 5.7 | 33.7-64.9 μm (>99% by weight, 0.1% by number) |
| | 951 nm ± 151.9 | |

Additional Combustion Characterization

Additional combustion testing was conducted for FGS-$Bi_2O_3$/Al experimental composites of the invention. The testing determined combustion wave speed and pressure-time using optical methods. The methods employed included a combination of photodiodes & fiber optics with a closed cell reactivity setup. The test set-up followed previous work by the present inventors and colleagues and is described in BezmeInitsyn, R. et al, "Modified Nanoenergetic Composites with Tunable Combustion Characteristics for Propellant Applications," Propellants, Explosives, Pyrotechnics 35 (4), 384 (2010). The values of combustion wave speed and the pressurization rate are a measure of the rate of reaction propagation. The tests confirmed that the self-assembled nanoenergetic composites show enhanced reaction rates, which we attribute to higher interfacial contacts between oxidizer and fuel. The peak pressure and the pressurization rate data was discussed above with respect to FIG. 4A. These experiments with GO-based self-assembled nanoenergetic powders were conducted at nearly 15% TMD, which is relatively a low % TMD regime. Usually, at low % TMD convective heat transfer dominates. The peak pressure shows a steady increase owing to higher amount of gas generated with increasing amount of GO sheets content. The pressurization rate increases with increasing GO up to 2 wt. % GO content and thereafter shows a decrease. The self-assembly with intimate packing of $Bi_2O_3$ and Al nanoparticles on GO sheets could lead to enhanced heat transfer via conductive mechanism up to 2%. Thus, the nanothermite reaction with self-assembly dominates in this region up to 2%. On the other hand, when the GO content is as high as 5 wt. %, it would have changed the optimum equivalence ratio between fuel and oxidizer. As a result, the increased convection effects owing to higher gas generation at 5 wt. % GO content and the self-assembly may not be enough to offset the experimental condition of changed equivalence ratio. However, taking into account the role of GO in the calculation of equivalence ratio that defines the amount of fuel and oxidizer, the composite might have exhibited higher pressurization rates. The data illuminate the role of FGS as an oxidizer/fuel depending upon the oxygen content, and can therefore aid in determining the optimum equivalence ratio.

The optimum equivalence ratio for all types of FGS-based composites can be determined for each particular composite. This ratio provides the best combustion wave speed and the pressurization rate. To determine the role (an oxidizer or a fuel) of each type of FGS with different functional groups in nanoenergetic formulations, the materials can be subject to heat treatment in oxygen and argon ambients using differential scanning calorimetry. The total energy of the solid propellant formulations can be measured using bomb calorimetry and differential scanning calorimetry. Combustion measurements for different formulations (combustion wave speed and pressure—time characteristics as a function of % TMD), can be correlated with thruster performance and with basic material characteristics. Specific nanoenergetic propellant formulations in accordance with the invention can also be examined using force transducer measurements in conjunction with high speed photography to surface parameters such as thrust generation, burn duration, total impulse, specific impulse, volumetric impulse, and specific impulse density as a function of % TMD and equivalence ratio.

Thrust Characteristics

Figure 6:
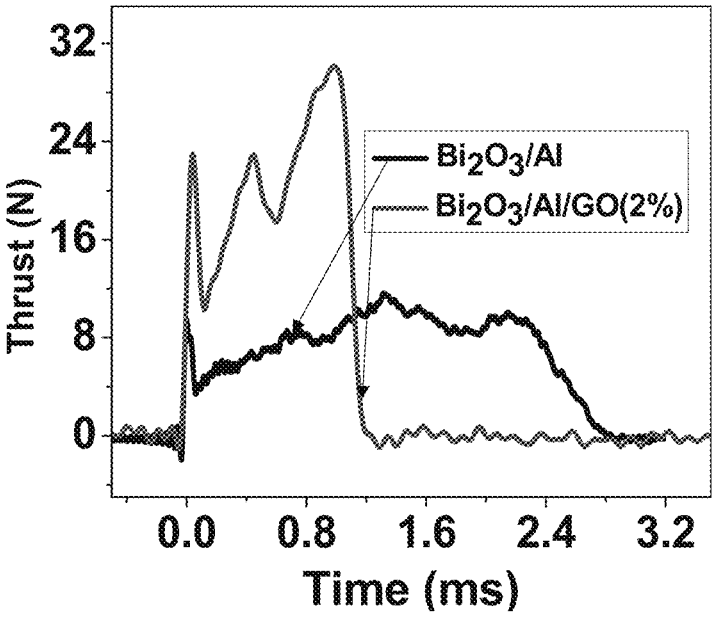
FIG. 6 illustrates thrust of example experimental $Bi_2O_3$/Al/FGS nanocomposite propellants as a function of time.
Figure 7:
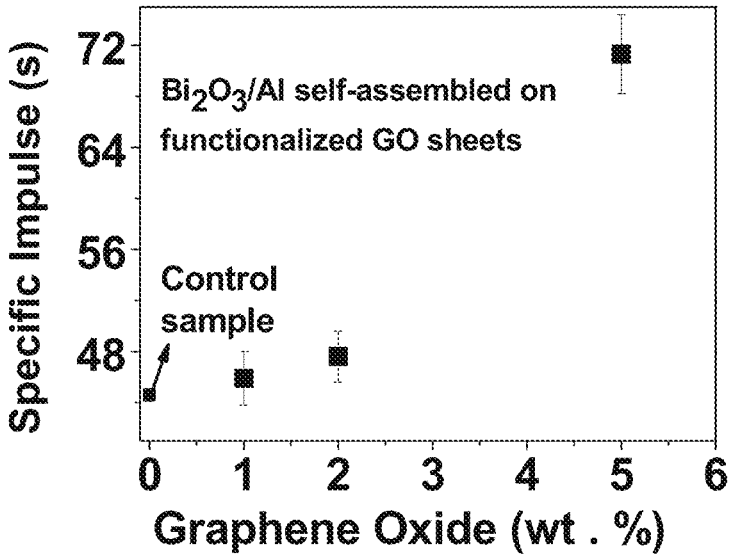
FIG. 7 illustrates specific impulse of example experimental $Bi_2O_3$/Al/FGS nanocomposite propellants as a function of FGS content.

Thrust was tested by measuring fast impulse thrust performance of nanothermite solid propellant of the invention packaged in millimeter scale thruster architectures. The test set up is given in previous work of the inventors and colleagues. See, US20110167795, published Jul. 14, 2011. FIG. 6 shows the thrust profiles measured as a function of time. The range of % TMD investigated (depending upon the GO content in these mixtures) is 58 to 63%. The specific impulse is plotted as a function of GO content FIG. 7. The values such as the mass of self-assembled material, flame duration, thrust amplitude, total impulse and specific impulse for various nanoenergetic composites are given in Table 4.

TABLE 4

Measured and estimated values of thrust characteristics

| GO (weight %) | Material mass (mg) | Average thrust (N) | Burn duration (ms) | Impulse (mN · s) | Specific impulse (s) |
|---|---|---|---|---|---|
| 0.0 | 51.0 ± 0.8 | 24.5 ± 0.7 | 0.9 ± 0.0 | 22.1 ± 0.6 | 44.1 ± 0.5 |
| 1.0 | 47.1 ± 1.1 | 27.7 ± 1.3 | 0.8 ± 0.1 | 21.2 ± 1.2 | 45.9 ± 2.1 |
| 2.0 | 46.9 ± 0.4 | 24.4 ± 0.8 | 0.9 ± 0.0 | 21.9 ± 0.7 | 47.6 ± 2.0 |
| 5.0 | 44.9 ± 0.2 | 6.9 ± 0.3 | 4.6 ± 0.3 | 31.3 ± 1.4 | 71.2 ± 3.1 |

A significant increase of specific impulse by 61% in comparison to a sample without FGS was realized with the addition of 5 wt. % GO (with respect to the total weight of the nanocomposite) in comparison to that obtained for a control sample of neat $Bi_2O_3$/Al nanothermite without FGS. The significant increase in specific impulse is attributed to several factors, including increased gas generation with increasing GO content in the propellant formulations; increased and convective heat transfer with increased thermal transfer due to the intimate proximity of Al and $Bi_2O_3$ (owing to high density packing of $Bi_2O_3$ and Al nanoparticles in close proximity to each other in the present self-assembled energetic materials, convective heat transfer; and higher total energy output generated by the decomposition reaction of GO either in air or with nanothermite. The experiments showed that the combustion performance and electrostatic discharge sensitivity of the self-assembled GO/Al/$Bi_2O_3$ materials can be tuned by modulating the weight content of GO.

Fourier Transform Infrared Testing and Raman Spectroscopy–FTIR and Raman Spectroscopy were conducted. The results identified FGS functional groups and oxygen surface functionalities that are available for self-assembly. Some functional groups (such as N—H) can energetically decompose. The C/O ratio indicates the number of functional groups covalently bonded to basal plane, and thereby can provide information about packing density, which is high in experimental nanocomposites of the invention. Table 5 provides data concerning the C/O and C/N ratio for FGS constituents used from example experimental nanocomposites of the invention. Nitrogen is a favorable energetic reactant and decomposition product. Nitrogen is included here by the use of Aminated Graphene. Amine (or aminated groups) are —$NH_2$. The data was obtained by X-ray photoelectron spectroscopy. (XPS).

TABLE 5

C/O and C/N ratio of FGS Constituents

| Sample | C/O atomic ratio | C/N atomic ratio |
|---|---|---|
| Graphite Nanoplatelets | 83 | NA |
| Graphene Oxide | 2.3 | NA |
| Reduced Graphene Oxide | 9.0 | 9.4 |
| Aminated Graphene | 9.2 | 10.7 |

CG Experiments

In additional experiments, commercial grade "as purchased" graphene (CG) was used in a self-assembly processes to form nanoenergetic composites. These sheets have a negative charge in solution. In these experiments, self-assembly was demonstrated and stable nanoenergetic composites formed. The appropriate amounts of various ingredients are calculated and given in Table below for equivalence ratio of 1.0 (stoichiometric). The amount of Al nanoparticles is calculated after taking into account the active Al content of 79 wt. %. For simplicity, commercial grade unfunctionalized graphene is referred as CG graphene.

TABLE 1

Various amounts of graphene, Bi2O3 and Al nanoparticles at phi value: 1.0 (stoichiometric)

| Commercial Graphene (750 m2/g) (wt. %) | Total weight (mg) | Commercial grade few layer graphene (mg) | Nanothermite (mg) | Bi2O3 (mg) | Al (mg) |
|---|---|---|---|---|---|
| 0 | 458.62 | 0.00 | 458.62 | 400.00 | 58.62 |
| 0.5 | 460.92 | 2.30 | 458.62 | 400.00 | 58.62 |
| 1.0 | 463.25 | 4.63 | 458.62 | 400.00 | 58.62 |
| 2.0 | 467.98 | 9.36 | 458.62 | 400.00 | 58.62 |
| 3.5 | 475.25 | 16.63 | 458.62 | 400.00 | 58.62 |
| 5.0 | 482.76 | 24.14 | 458.62 | 400.00 | 58.62 |

Although the Table shows the calculation for 3.5 wt. % and 5 wt. % also, we did sample preparation with unfunctionalized, as-purchased graphene only up to 2 wt. %.

The solvent system for dispersing graphene utilized DMF, as in the FGO experiments. Dispersions of $Bi_2O_3$ and Al used IPA, as in the FGO experiments.

TABLE 2

Amount of solvents used in the dispersions of graphene, $Bi_2O_3$ and Al nanoparticles.

| Commercial Graphene (750 m2/g) (wt. %) | Commercial grade few layer graphene (mg) | DMF (mL) | Bi2O3 (mg) | IPA for Bi2O3 dispersions (mL) | Al (mg) | IPA for Al dispersions (mL) |
|---|---|---|---|---|---|---|
| 0 | 0 | 0 | 400 | 1.5 | 58.62 | 1 |
| 0.5 | 2.30 | 4.61 | 400 | 1.5 | 58.62 | 1 |
| 1 | 4.63 | 9.27 | 400 | 1.5 | 58.62 | 1 |
| 2 | 9.36 | 18.72 | 400 | 1.5 | 58.62 | 1 |
| 3.5 | 16.63 | 33.27 | 400 | 1.5 | 58.62 | 1 |
| 5 | 24.14 | 48.28 | 400 | 1.5 | 58.62 | 1 |

To be consistent with the dispersions' preparation, appropriate amounts of CG graphene were dispersed in appropriate amounts of DMF using an ultrasonic bath by subjecting them to sonication for 8 hours. This duration is based on our earlier work with functionalized graphene oxide sheets. Caution must be taken in the following procedures to avoid any unintended ignition.

Aluminum nanoparticles in the state of dispersion were added to CG dispersions first and then sonicated for 1 hour, followed by the addition of $Bi_2O_3$ dispersions to the resulting CG/Al dispersions. After the addition of $Bi_2O_3$ dispersions to CG/Al dispersions, sonicate the solution again for 1 hour. The addition of Al and $Bi_2O_3$ dispersions can be reversed to obtain similar results, as demonstrated via the FGO experiments.

The dispersions of CG (0.5%)/Al/$Bi_2O_3$ and CG (1%)/Al/$Bi_2O_3$ exhibited homogeneous yet spontaneous precipitation and the precipitation was complete within 2 hours (about 85 to 90 wt. % of the solid content precipitated within first 10 minutes). The CG (2%)/Al/$Bi_2O_3$ dispersion shows time-dependent homogeneous precipitation after fairly long hours. All composites remain stable for weeks.

Typical parameters for the CG were Surface area: 785 $m^2/g$ for unfunctionalized as-purchased graphene. Zeta potential measurements with 0.001 w/v. % concentration (100 micrograms of CG graphene dispersed in 10 mL of IPA). Typical measurements for unfunctionalized CG graphene: −31 mV and functionalized CG graphene: −80 mV.

Figure 8:
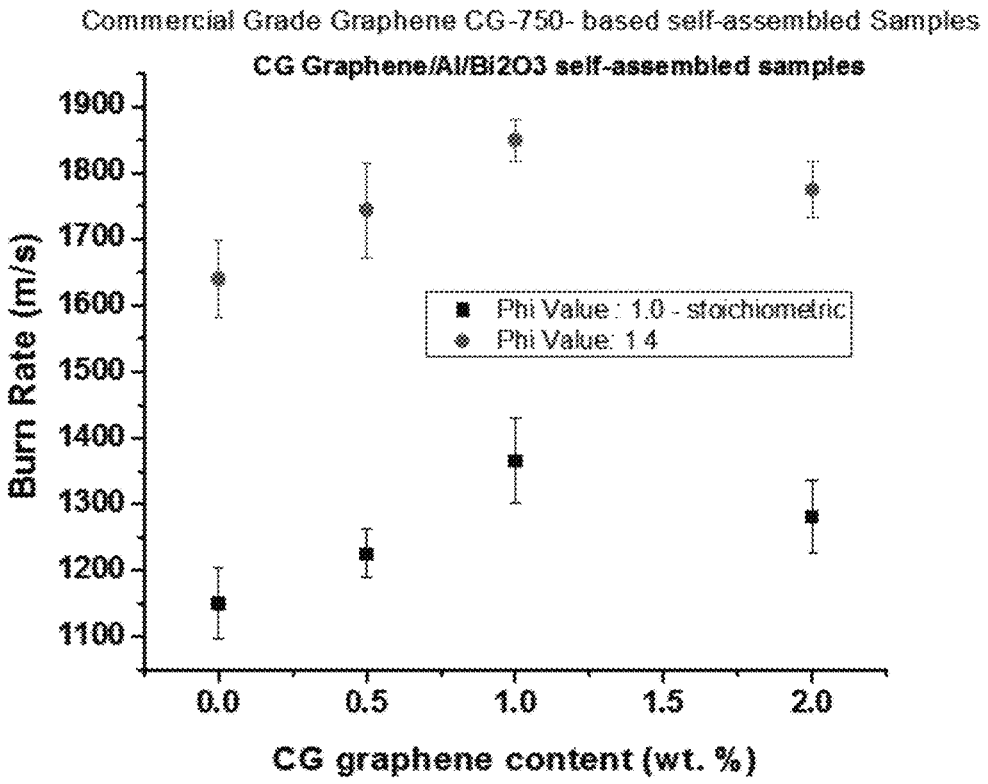
FIG. 8 illustrates burn rate measurements of example $Bi_2O_3$/Al/FGS nanocomposite propellants as a function of commercial grade graphene (unfunctionalized)(CG) content.
Figure 9:
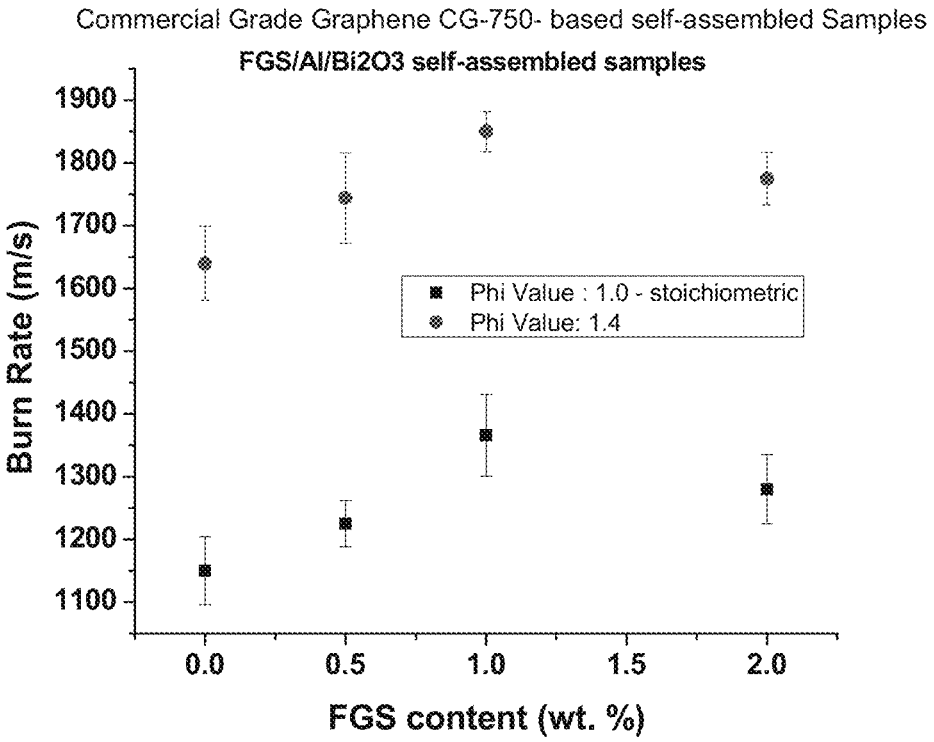
FIG. 9 illustrates burn rate measurements of example $Bi_2O_3$/Al/FGS nanocomposite propellants as a function of FGO content.

FIG. 8 illustrates burn rate measurements of example $Bi_2O_3$/Al/FGS nanocomposite propellants as a function of commercial grade graphene (unfunctionalized)(CG) content. Substantial increases in burn rate are achieved compared to another phi value (stoichiometric ratio)−phi=14 and phi=1.0. FIG. 9 shows burn rates that are comparable for FGS samples of the invention.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An energetic nanocomposite comprising Al fuel nanoparticles and oxidizer nanoparticles covalently bonded to functionalized graphene sheets.

2. The nanocomposite of claim 1, wherein the oxidizer comprises positively charged $Bi_2O_3$ nanoparticles.

3. The nanocomposite of claim 1, wherein the graphene sheets are a few nm in thickness and a couple microns in diameter.

4. The nanocomposite of claim 1, wherein the functionalized graphene sheets comprise graphene oxide.

5. The nanocomposite of claim 1, wherein the functionalized graphene sheets comprise at least 0.5 wt % of the energetic nanocomposite.

6. The nanocomposite of claim 1, wherein the functionalized graphene sheets comprise reduced graphene oxide.

7. The nanocomposite of claim 1, wherein the functionalized graphene sheets comprise aminated graphene.

8. The nanocomposite of claim 1, wherein the functionalized graphene sheets are tailored at the molecular level with energetic groups.

9. The nanocomposite of claim 8 wherein the energetic groups comprise nitro (—$NO_2$) or amine (—$NH_2$) groups.

10. The nanocomposite of claim 1, wherein the functionalize graphene sheets are functionalized functional groups of hydroxyl, epoxy, carbonyl or carboxylic acid groups.

11. An energetic nanocomposite consisting of Al fuel nanoparticles and oxidizer nanoparticles covalently bonded to functionalized graphene sheets.

* * * * *